United States Patent [19]

Okuda

[11] Patent Number: 4,658,845

[45] Date of Patent: Apr. 21, 1987

[54] UMBRELLA CLOTH MOUNTING ASSEMBLY AND METHOD

[75] Inventor: Toshio Okuda, Hirakata, Japan

[73] Assignee: 'totes', incorporated

[21] Appl. No.: 812,972

[22] Filed: Dec. 24, 1985

[30] Foreign Application Priority Data

Dec. 29, 1984 [JP] Japan ..... 59-197742[U]

[51] Int. Cl.[4] ..... A45B 25/18; B21D 39/00; B23P 11/00

[52] U.S. Cl. ..... 135/36 RT; 29/509; 29/522 R

[58] Field of Search ..... 29/512, 25, 523, 509, 29/522 R; 135/36 RT, 44, 36 F, 36 R; 112/104

[56] References Cited

U.S. PATENT DOCUMENTS

| | | | |
|---|---|---|---|
| 78,893 | 6/1858 | Pierce | 135/36 RT |
| 404,039 | 5/1889 | Harris | 135/36 RT |
| 4,089,416 | 5/1978 | Sims | 135/36 RT |

FOREIGN PATENT DOCUMENTS

| | | |
|---|---|---|
| 608764 | 9/1948 | United Kingdom . |
| 656880 | 9/1951 | United Kingdom . |

*Primary Examiner*—Charlie T. Moon
*Attorney, Agent, or Firm*—Wood, Herron & Evans

[57] ABSTRACT

A mounting assembly for attaching an umbrella cover or cloth to the ribs of an umbrella without sewing includes a flattened section integrally formed in the rib near the tip having opposed upper and lower surfaces each formed with a seat, and a throughbore extending between the seats which receives a rivet. A peripheral portion of the umbrella cloth is first inserted through the bore in the flattened section, and then the rivet is inserted into the bore so that the umbrella cloth is clamped between the head of the rivet and the seat in the upper surface. The lower, deformable end portion of the stem of the rivet is thereafter flattened against the seat in the lower surface of the flattened section, with the umbrella cloth interposed therebetween, to securely attach the umbrella cloth to the rib.

7 Claims, 4 Drawing Figures

UMBRELLA CLOTH MOUNTING ASSEMBLY AND METHOD

BACKGROUND OF THE INVENTION

This invention relates to umbrellas, and, more particularly, to a mounting assembly for connecting an umbrella cover or cloth to the ribs of an umbrella.

The cover or cloth fabric sections of an umbrella are supported in the open and closed position by a plurality of spaced ribs each formed with a small hole near the rib tip. In order to mount the umbrella cloth to the ribs, the portion of the periphery of the umbrella cloth which overlies the rib tip is sewn to the rib by use of a needle and thread with the thread passing through the hole in the rib and attaching to the umbrella cloth. This prior art method of attaching the umbrella cloth to the ribs is widely used but results in two problems.

The first problem which arises in sewing the umbrella cloth to the rib tip is one of breakage. After an umbrella has been used for a period of time, the thread used to attach the umbrella cloth to the rib tends to break. Breakage of the thread is accelerated if the hole in the rib has a sharp edge, e.g., burs, but the thread also breaks due to weakening by repeated wettings and dryings. Any breakage of the threads along the sewn connection between the umbrella cloth and rib creates loosening or separation of the umbrella cloth from at least one rib causing the umbrella cloth to be turned upwardly.

The second problem or limitation of the prior art method of sewing the umbrella cloth to the ribs of an umbrella is the high cost of the tedious and labor-intensive sewing operation. In order to reduce manufacturing costs, it is desirable to eliminate as much as possible the labor involved in the umbrella cloth attachment operation.

SUMMARY OF THE INVENTION

It is therefore among the objects of this invention to provide a mounting assembly and method of attachment of an umbrella cover or cloth to the ribs of an umbrella which eliminates hand sewing and which forms a neat, wrinkle-free and crease-free connection between the umbrella cloth and ribs.

These objectives are accomplished with a mounting assembly which comprises a flattened section formed near the tip of each rib having upper and lower surfaces with a bore extending therebetween, and a rivet including a head connected to a stem having a deformable end portion. In order to attach the umbrella cloth to the ribs, a peripheral portion of the umbrella cloth is first inserted through the bore in the rib, and then the rivet is inserted into the bore so that a portion of the umbrella cloth is clamped between the rivet's head and the upper surface of the flattened section of the rib. The deformable end portion of the stem opposite the head is then flattened against the lower surface of the rib, with the umbrella cloth interposed therebetween, to complete the attachment of the umbrella cloth to the rib.

More specifically, in a presently preferred embodiment of this invention an integral portion of the rib near its tip is crimped or flattened forming upper and lower substantially concave-shaped surfaces on opposite sides of the rib. The arcuate, concave shape of the upper and lower surfaces forms opposed seats, one of which receives the head of the rivet and the other of which receives the flattened, deformable end portion of the stem of the rivet. Preferably, the depth of the seat formed in the upper surface of the flattened section of the rib is about equal to the thickness of the head of the rivet, and the depth of the seat formed in the lower surface of the rib is about equal to the thickness of the flattened, deformable end portion of the stem.

The umbrella cover or cloth is formed of a plurality of generally triangular-shaped sections of fabric material which are joined along their edges. The points at which the fabric sections meet at the outer periphery of the umbrella cloth form attachment points or portions which are inserted through the hole in the flattened section of the rib. An important aspect of this invention is that such attachment points or portions of the outer periphery of the umbrella cloth are secured to the ribs without sewing, and without any locking or attachment elements mounted to the umbrella cloth.

In a mounting operation, the attachment points or portions at the outer periphery of the umbrella cloth are first extending over a portion of the concave seat formed in the upper surface of the rib. The umbrella cloth is then inserted through the bore in the rib so that at least an outermost end portion of the umbrella cloth extends beyond the lower surface of the rib. The rivet is inserted into the bore so that its head nests within the concave seat and forces the umbrella cloth interposed therebetween against the seat. The portion of the umbrella cloth which extends within the bore in the rib is held in place by the stem of the rivet. Attachment of the umbrella cloth to the rib is completed by flattening the deformable end portion of the stem to clamp the outermost end of the umbrella cloth against the concave seat formed in the lower surface of the rib.

The umbrella cloth is therefore securely fastened by the rivet within the seats formed in the upper and lower surfaces of the flattened section of the rib, and along the length of the bore. Since the concave seats in the upper and lower surfaces of the rib are formed at a depth approximately equal to the thickness of the head of the rivet and the flattened, deformable end portion of the stem, the ends of the rivet are substantially flush with the outer surface of the rib to add to the aesthetic appeal of the connection between the umbrella cloth and rib. In addition, the concave shape of the seats in the flattened portion of the rib permits attachment of the umbrella cloth to the rib without creating wrinkles or creases in the umbrella cloth.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
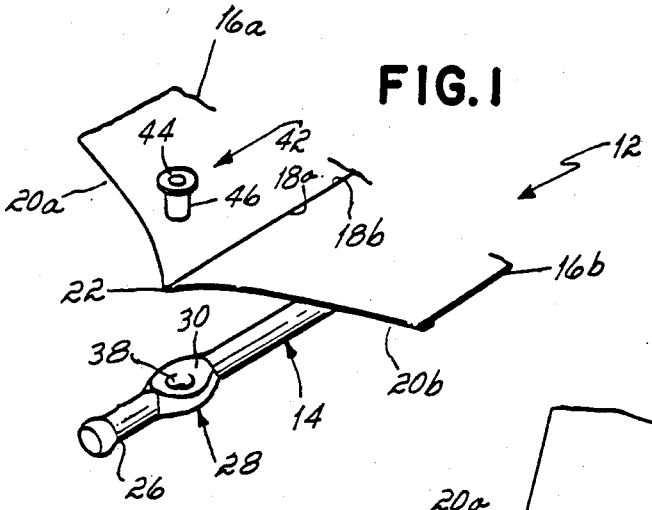
FIG. 1 is a perspective, partially exploded view of a portion of the umbrella cloth, one rib and a rivet all prior to attachment of the umbrella cloth to the rib.
Figure 3:
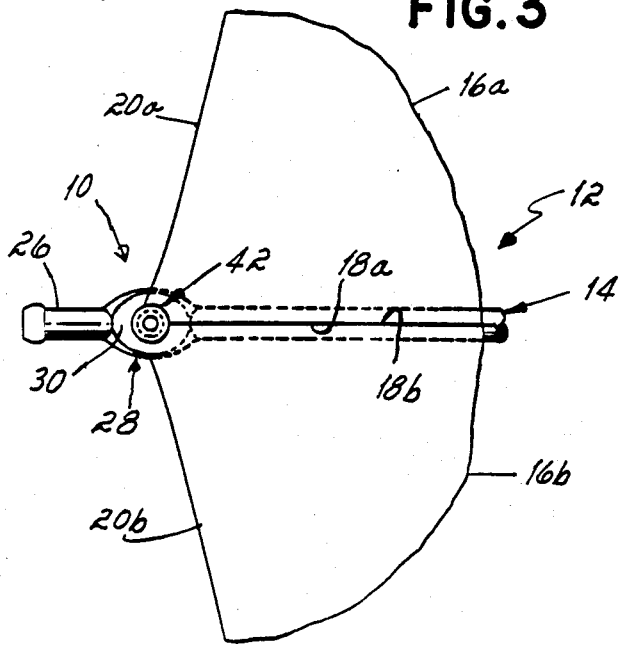
FIG. 3 is a plan view of the mounting assembly herein after insertion of the rivet into the rib.

Referring now to the drawings, the mounting assembly 10 of this invention is intended to attach an umbrella cover or cloth 12 to the ribs 14 of an umbrella (not shown). Only a portion of the umbrella cloth 12 and one of the ribs 14 are shown in the drawings for purposes of illustrating the invention. The umbrella cloth 12 comprises a plurality of generally triangular-shaped sections, such as 16*a, b,* formed of a suitable fabric material. As shown in FIGS. 1 and 3, each fabric section 16*a, b* is formed with a mating edge 18*a, b* and an outer edge 20*a, b,* respectively. The mating edges 18*a, b* of the fabric sections 16*a, b* are joined together and form an attachment point or portion 22 at the outer periphery of the umbrella cloth 12 defined by their outer edges 20*a, b.*

Figure 2:
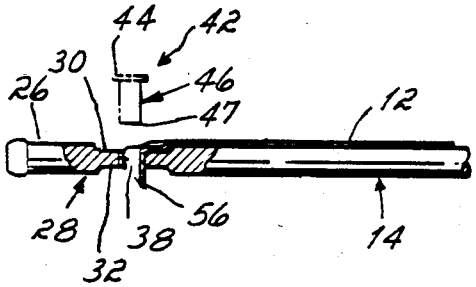
FIG. 2 is a side view in partial cross section of the umbrella cloth inserted within the bore in the rib and the rivet in a position just prior to insertion into the rib.
Figure 4:
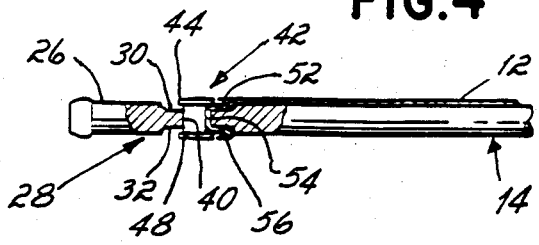
FIG. 4 is a partial cross sectional view of the mounting assembly herein in an assembled position.

Each of the ribs 14 includes an outer tip 26 and a crimped or flattened section 28 integrally formed in the rib 14 inwardly from the tip 26. As best shown in FIGS. 2 and 4, the flattened section 28 is formed with opposed upper and lower surfaces on opposite sides of the rib 14. The upper and lower surfaces are formed with seats 30, 32, respectively, each having a generally arcuate, concave shape which extend inwardly from the outer surface of the rib 14 toward its center. A bore 38 extends between the seats 30, 32 forming an annular wall 40 in the rib 14.

The mounting assembly 10 also includes a rivet 42 having a head 44 connected to one end of a stem 46. The opposite end of stem 46 includes a deformable portion 47 which can be flattened to form a head 48 as shown in FIG. 4.

The umbrella cloth 12 is mounted to the rib 14 in the following manner. As shown in FIG. 2, the attachment portion 22 of the umbrella cloth 12 is first inserted through the bore 38 formed in the flattened section 28. When in place, the attachment portion 22 of the umbrella cloth 12 overlies at least a portion of the seat 30 formed in the upper surface of flattened section 28 and extends along the annular wall 40 formed by the bore 38. Upon initial insertion of the attachment portion 22, as shown in FIG. 2, its lowermost end portion 56 extends below the seat 32 in the lower surface of the flattened section 28.

As shown in FIGS. 2 and 4, the rivet 42 is then inserted into the bore 38 so that its head 44 clamps an upper portion 52 of the umbrella cloth 12 against the seat 30 in the upper surface of the flattened section 28. The stem 46 of the rivet 42 extends within the bore 38 against an intermediate portion 54 of the umbrella cloth 12 interposed between the stem 46 and the annular wall 40 formed by the bore 38. To complete the attachment operation, the deformable end portion 47 of stem 46 is then flattened to form a head 48 on the bottom of rivet 42 which clamps the lowermost end portion 56 of the umbrella cloth 12 against the seat 32 formed in the lower surface of flattened section 28.

As shown in FIG. 4, the mounting assembly 10 of this invention provides a positive attachment between the umbrella cloth 12 and the rib 14. The umbrella cloth 12 is securely clamped to the rib between the two heads 44, 48 of the rivet 42, and is frictionally held by the stem 46 of the rivet 42 against the annular wall 40 formed by the bore 38. In a presently preferred embodiment, the heads 44, 48 are formed with a thickness approximately equal to the depth of the seats 30, 32 in the upper and lower surfaces, respectively. Therefore, as shown in FIG. 4, the rivet heads 44, 48 are substantially flush with the umbrella cloth 12 on the rib 14 to provide an attractive appearance. Additionally, the generally arcuate, concave shape of the seats 30, 32 prevents the formation of creases or wrinkles where the umbrella cloth 12 is connected to the rib 14.

While the invention has been described with reference to a preferred embodiment, it will be understood by those skilled in the art that various changes may be made and equivalents may be substituted for elements thereof without departing from the essential scope of the invention. In addition, many modifications may be made to adapt a particular situation of material to the teachings of the invention without departing from the essential scope thereof. Therefore, it is intended that the invention not be limited to the particular embodiment disclosed as the best mode contemplated for carrying out the invention, but that the invention will include all embodiments falling within the scope of the appended claims.

What is claimed is:

1. A mounting assembly for attaching an umbrella cloth to the ribs of an umbrella comprising:

a flattened section integrally formed in the rib, said flattened section having opposed upper and lower surfaces with a bore formed therebetween;

a rivet having a head connected to a stem formed with a deformable end portion;

a peripheral portion of the umbrella cloth being insertable through said bore in said flattened section, said rivet then being insertable into said bore so that the umbrella cloth is clamped between said head of said rivet and said upper surface of said flattened section, said deformable end portion of said stem thereafter being flattened against said lower surface of said flattened section with the umbrella cloth interposed therebetween to attach the umbrella cloth to the rib.

2. The mounting assembly of claim 1 in which said upper surface of said flattened section is formed with an arcuate, substantially concave shape defining a seat for receiving said head of said rivet, and said lower surface of said flattened section is formed with an arcuate, substantially concave shape defining a seat for receiving said flattened end portion of said stem.

3. The mounting assembly of claim 2 in which said seat in each said upper and lower surfaces extends inwardly from the outer surface of the rib toward its center at a depth approximately equal to the thickness of said head and said flattened end portion of said rivet respectively so that upon insertion of said rivet into said bore said head and flattened end portion are substantially flush with the outer surface of the rib.

4. The mounting assembly of claim 1 in which the umbrella cloth is formed of a plurality of substantially triangular-shaped sections of fabric material each having a mating edge and an outer edge, said triangular-shaped sections being connected together at said mating edges to form attachment portions at the periphery of the umbrella cloth defined by said outer edges, said attachment portions being insertable within said bore of said flattened section and being clamped between said rivet and said seats.

5. The mounting assembly of claim 1 in which said bore forms an annular wall within said flattened section of the rib, a peripheral portion of the umbrella cloth extending between a portion of said annular wall and said stem of said rivet.

6. A method of attaching an umbrella cloth to the rib of an umbrella comprising the steps of:

inserting a peripheral portion of the umbrella cloth through a bore formed in the rib;

inserting a rivet having a head connected to a stem into the bore, a portion of the umbrella cloth being clamped between the head of the rivet and one side of the rib;

flattening a deformable portion of the stem of the rivet against the opposite side of the rib with the umbrella cloth interposed therebetween to secure the umbrella cloth to the rib.

7. The method of claim 6 further including the steps of:

forming said one side of the rib with an arcuate, concave-shaped surface to define a seat for receiving the head of the rivet; and forming said opposite side of the rib with an arcuate, concave-shaped surface to define a seat for receiving said flattened deformable portion of said stem of said rivet.

* * * * *